United States Patent [19]

Barthe et al.

[11] 4,256,186

[45] Mar. 17, 1981

[54] ROOF DRILLING AND BOLTING APPARATUS

[75] Inventors: Henry P. Barthe, Pittsburgh; William R. Cobb, Murrysville, both of Pa.

[73] Assignee: Schroeder Brothers Corporation, McKees Rocks, Pa.

[21] Appl. No.: 30,220

[22] Filed: Apr. 16, 1979

[51] Int. Cl.[3] ..... E21C 11/02; E21D 19/00; E21D 20/00

[52] U.S. Cl. ..... 173/23; 173/38; 173/52; 175/219; 299/11

[58] Field of Search ..... 173/23, 36, 38, 147, 173/52; 175/219, 315; 299/11

[56] References Cited

U.S. PATENT DOCUMENTS

| | | | |
|---|---|---|---|
| 2,683,587 | 7/1954 | Gunning | 173/36 |
| 2,771,273 | 11/1956 | Pond | 173/38 |
| 2,832,567 | 4/1958 | Fletcher et al. | 173/147 X |
| 3,080,007 | 3/1963 | Long et al. | 173/38 |
| 3,375,880 | 4/1968 | Pyles et al. | 173/38 X |
| 3,951,215 | 4/1976 | Galis | 173/23 |
| 4,022,026 | 5/1977 | Childress | 173/23 X |
| 4,050,259 | 9/1977 | Childress | 173/23 X |
| 4,079,792 | 3/1978 | Paul et al. | 173/38 X |
| 4,108,253 | 8/1978 | Woodford | 173/38 X |
| 4,117,894 | 10/1978 | Saunders | 173/23 |
| 4,172,615 | 10/1979 | Hakes | 173/27 X |
| 4,173,371 | 11/1979 | Kopas | 173/23 X |

*Primary Examiner*—Robert Mackey

*Attorney, Agent, or Firm*—Webb, Burden, Robinson & Webb

[57] ABSTRACT

An operator cab and drilling assembly for a roof drilling and bolting device. The cab comprises a floor and a canopy having extensible hydraulic means for adjusting the distance between the cab floor and at least the front edge of the canopy. A horizontal rail extends along the entire length of the front edge of the floor and is spaced therefrom. A roof bolting and drilling apparatus slidably engages the horizontal rail. The rail is mounted by swinging arms to always be parallel to the cab floor.

6 Claims, 6 Drawing Figures

ROOF DRILLING AND BOLTING APPARATUS

BACKGROUND

This invention relates to a unitary operator cab and drilling assembly which is useful in a roof drilling and bolting device. It has particular application to the mine roof drilling and bolting apparatus disclosed in our co-pending application filed of even data herewith entitled "Roof Bolting Device bearing Ser. No. 030,219."

Mining machines with unitary operator cabs and protective canopies are known including those boom mounted devices such as in U.S. Pat. No. 3,893,520 wherein the canopy is fixed to the boom which carries the drilling assembly and those devices wherein the cab is fixed relative to the drilling apparatus and the two move rectilinearly as a unit relative to the chassis such as shown in U.S. Pat. No. 4,050,259. It is an advantage according to this invention that the drilling assemblies mounted in front of the canopy covered cab and the drill pod can move transversely relative to the cab providing for transverse spacing of the roof bolts without repositioning of the cab or the chassis supporting the cab. The drilling assembly is uniquely mounted along the front edge of the cab upon a horizontal rail spaced from the front edge of the floor of the cab. The rail is mounted by swinging arms to always be parallel to the cab floor. In this way, the entire drilling assembly may be reached from the cab by the operator in whatever position the drill pod may be placed. Further, the horizontal rail can swing upwardly if unusual mine floor conditions are encountered either during tramming or drilling and bolting. As a result of the mounting the direction of the drilling pod axis remains generally vertical under all conditions.

Due to the spacing of the horizontal rail from the front edge of the cab floor, it is possible to position an upright tower for elevating the drill pod directly over the mine floor with no obstructions between the base of the upright tower and the mine floor. In this way, the base may be extended directly down to the mine floor during drilling so that the resultant drilling forces are not transmitted to the cab and/or the chassis supporting the cab.

SUMMARY OF THE INVENTION

Briefly according to this invention, there is provided an operator cab and drilling assembly for a roof drilling and bolting device comprising a floor or deck which is generally planar and horizontal. A canopy, usually a grillwork canopy, is spaced over the floor. Extensible hydraulic means are provided for adjusting the distance between the cab floor and at least the front edge of the canopy. A horizontal rail extends the entire length along the front edge of the floor spaced therefrom. The rail is mounted by swinging arms to always be parallel to the cab floor. A carriage slidably engages the rail for transverse movement. Hydraulic means are provided for actuating the transverse movement of the carriage upon the track. An upright tower is mounted to the carriage and is spaced between the horizontal rail and the front edge of the floor of the cab. A drill pod for receiving drill steel and a hydraulic motor is slidably mounted to said upright tower for being raised and lowered. Hydraulic apparatus is provided for actuating the vertical movement of the drill pod. The operator, while under the canopy, can adjust the height of the canopy for maximum comfort and accessibility and can easily adjust the drill pod location and have ready access to the drill pod.

According to a preferred embodiment, the horizontal rail comprises a beam supporting an orbiting chain turning over sprockets journaled in each lateral end thereof. The carriage by said chain.

According to yet another preferred embodiment, the upright tower mounted to said first carriage comprises a hollow box having an extensible hydraulic means therein for raising and lowering a second carriage for the drill pod. It is also preferred that a centralizer for the drill steel be mounted atop the upright tower for automatically centering the drill steel.

The mount may comprise two parallel lower arms extending forward from the cab and being journaled to the outer front edges of the cab floor. A crossbar is journaled for free rotation in the forward ends of the lower arms. A horizontal rail is rigidly mounted to the crossbar. An upper arm pivotally mounted to the rail at one end and at the other end pivotally mounted to the cab is arranged such that lines through the pivot points of the upper and lower arms always define a parallelogram. Thus, as the crossbar is urged upwardly, the rail rotates so that it or anything attached thereto is always pointed in the same direction. Preferably, a track fixed to the front edge of the cab floor slidably receives the first carriage when the crossbar is rotated to its most downward position.

DRAWINGS

Further features and other objects and advantages of this invention will become clear from the following detailed description made with reference to the drawings in which FIG. 1 is a perspective view of a roof drilling and bolting apparatus having two unitary operator cabs and drilling assemblies according to this invention mounted on the front thereof, FIG. 2 is a side elevation of the device illustrated in FIG. 1, FIG. 3 is a broken away plan view of two operator cabs and drilling assemblies shown in FIG. 1, FIG. 4 is a front elevation of two operator assemblies, and FIGS. 5 and 6 are details of the mount in two different positions.

DESCRIPTION OF THE PREFERRED EMBODIMENT

Figure 1:
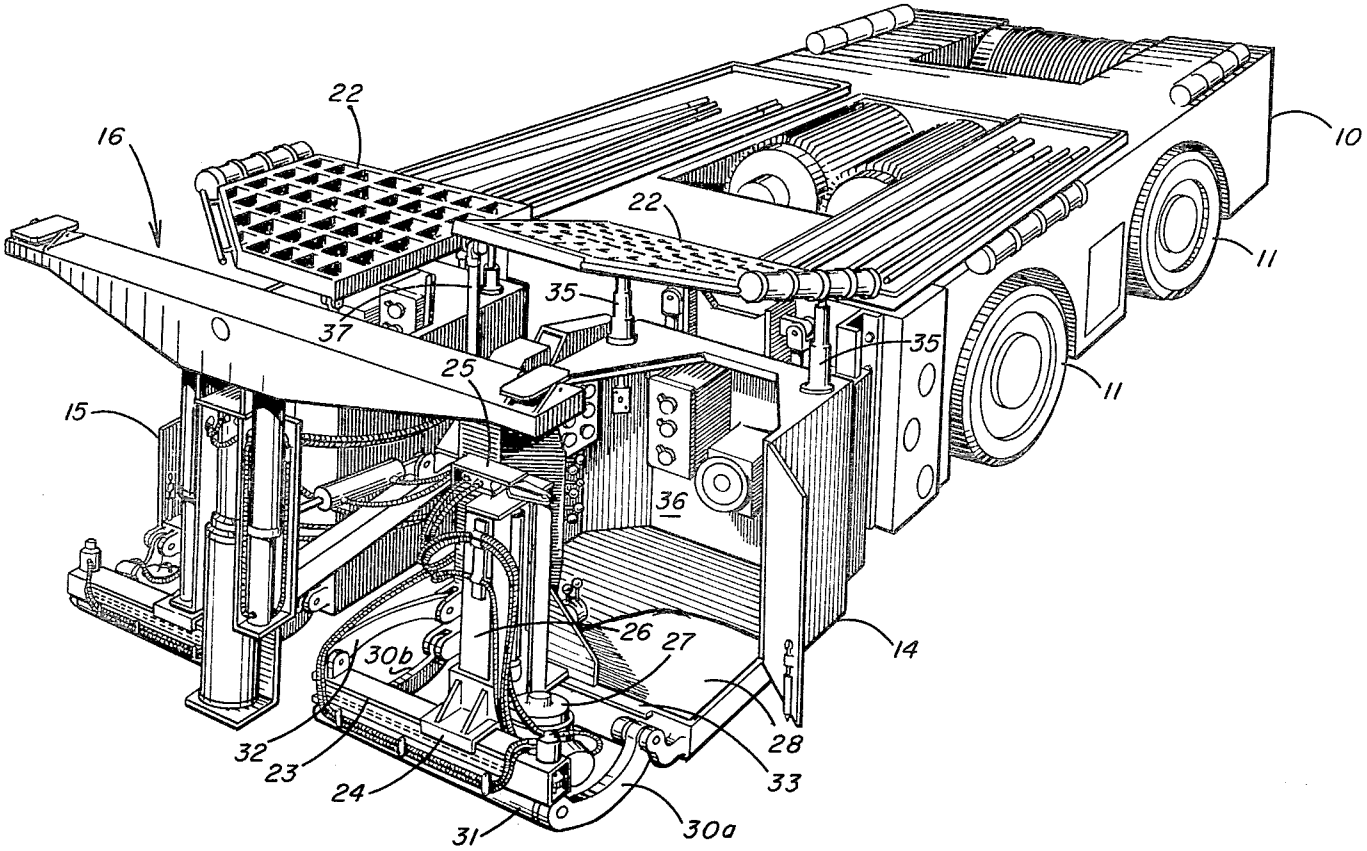

Referring now to FIG. 1, there is shown roof drilling and bolting machine comprising a chassis 10 mounted on wheels 11. On the front of the machine are two operator cabs 14 and 15. Positioned in front of the cabs is a temporary roof support 16 which is not directly related to the invention described in this application.

Mounted in front of each cab is a drilling assembly. Since the two cabs and their associated drilling assemblies are basically identical only one will be described in detail. Horizontal rail 23 is mounted spaced from the lower front edge of the cab deck 28. Lower arms **30*a* and 30*b* are pivotally mounted to the outer front edge of the cab deck at one end. The lower arms carry a crossbar 31 journaled therein at the other end. The horizontal rail 23 is fixed to the crossbar 31 and rotates around the axis of the crossbar as the crossbar turns. An upper arm 32 is pivotally connected to the front of the cab and at the other end to the horizontal rail 23. The upper arm 32 being pivotally joined at each end defines two pivot points. Likewise, the lower arm 30b defines two pivot points. Lines through the pivot points of the lower arm 30b and upper arm 32** at all times define a parallelogram.

A carriage 24 slidably engages the rail 23 and thus may be moved horizontally on the rail 23. The horizontal rail 23 comprises a beam (box beam or I beam, for example) supporting an orbiting chain turning over sprockets 20 journaled over each lateral end of the beam. The carriage 24 is fixed to the chain at one location thereon. One sprocket is driven by a hydraulic motor to orbit the chain and thus horizontally position the drill rod.

An upright tower 26 is carried by the carriage 24. A drill pod 27 is slidably mounted to the upright tower. The upright tower 26 is a hollow box-like structure having an extensible hydraulic means therein for raising and lowering the drill pod. The carriage 24 not only engages the horizontal track 23 but, in the downwardmost position of the crossbar 31, the horizontal track also engages a horizontal track 33 fixed to the front edge of the cab deck 28.

Figures 2, 3, 4, 5, 6:
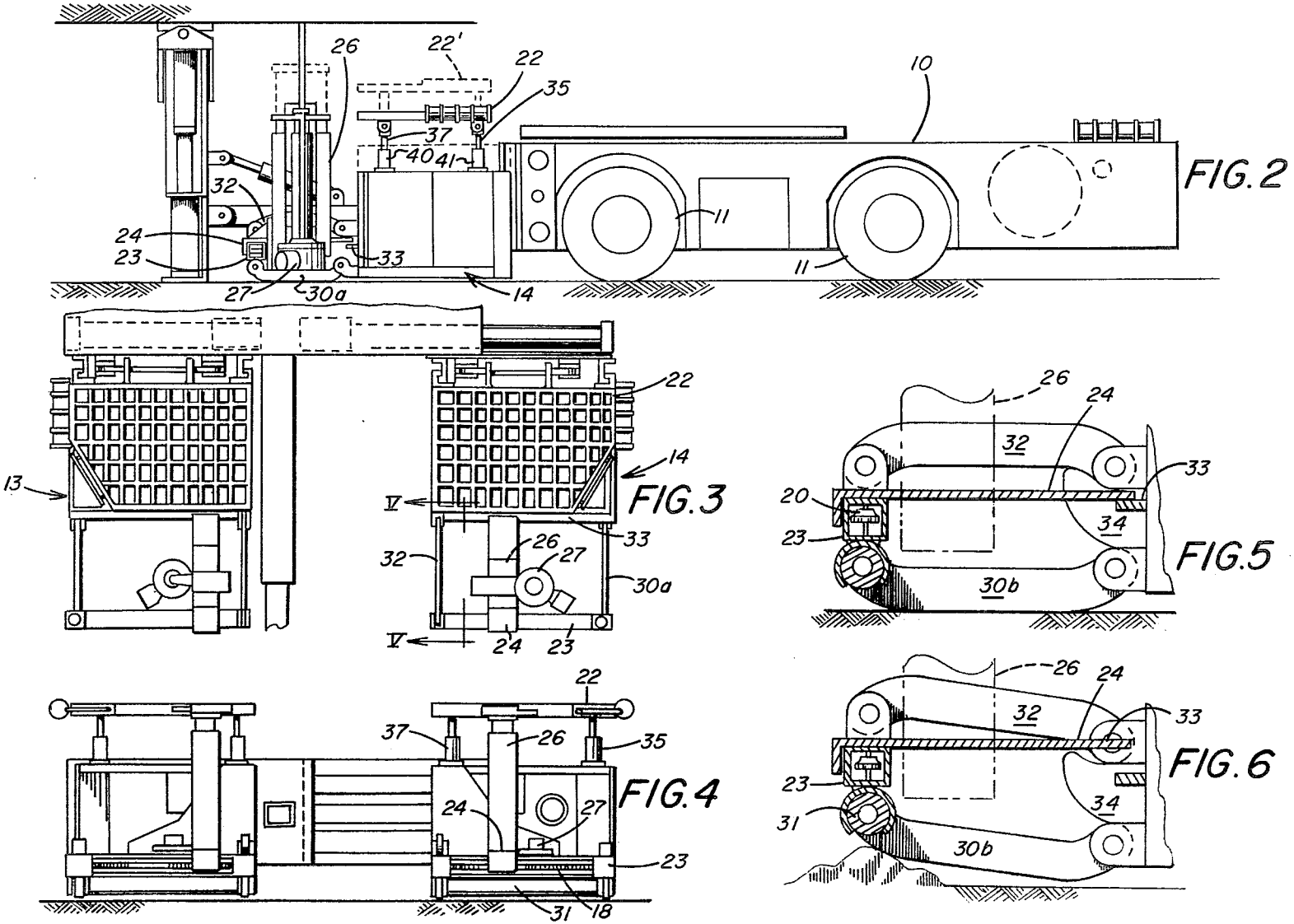

Referring now to FIG. 2, there is shown a side elevation of the entire apparatus. The cab has a canopy 22 over the top thereof. The canopy is supported above the deck by standards 35 near the the backwall 36 (See FIG. 1) of the cab. The connections between the standards 35 and the canopy 22 are pivotal. The canopy is also supported by a front standard 37 pivotally connected thereto. The front standard is a hydraulic piston 37 associated with a hydraulic cylinder 40 permitting the canopy to be swung upwardly near the front thereof as shown in FIG. 1 for the cab on the left side of the machine. The rearward standards 35 may also be pistons associated with hydraulic cylinders or may be arranged for slidable engagement with a cylindrical base 41 permitting manual upward and downward adjustment of the standard 35. In some mining operations where the depth of the seam is sufficiently high, the canopy may be raised to an alternate upward position 22' as shown in FIG. 2.

Referring now to FIGS. 3 and 4, it an be seen that the drilling assembly in the front of the cab (including at least the elements 23, 26 and 27) are easily accessible to an operator stationed within the cab no matter what the position of the drill pod 27. Preferably the upright tower 26 has a drill steel stabilizer 25 (See FIG. 1) mounted to the top thereof for guiding the steel at the start of a boring and during boring. This feature, along with the arrangement of the drilling pod directly in front of the cab makes the cab comfortable to work in and eliminates any need for the operator to leave the cab during the drilling and bolting procedure.

By reference to FIG. 3, it may be observed that the upright drilling tower 26 is always spaced directly over the mine floor with no intervening apparatus therebetween. Thus, the drilling tower 26 may have a base which lowers to the drilling floor prior to the time the drill steel in the pod 27 engages the mine roof. Thus, the resultant forces of drilling are not transferred to the rail 23, the cab 14 or the chassis 10. A particularly suitable upright tower and drill pod positioning apparatus are described in our co-pending patent application filed of even date herewith entitled "Rectilinear Positioning Device for Drilling Pod" bearing Ser. No. 030,221, now abandoned.

Referring now to FIGS. 5 and 6, the planographic mount for the horizontal track is shown by partial sections taken along lines V—V in FIG. 3. The relative location of the upright tower 26 is illustrated by the dashed lines. FIG. 5 illustrates the normal travelling position with the carriage 24 resting on both the horizontal rail 23 and the horizontal track 33. It may be desirable to provide stops 34 (only shown in FIGS. 5 and 6) mounted to the cab for restricting the downward rotation of the upper arms 32 to thus limit the amount of force applied to the track 33 by the carriage 24. Otherwise, it may be difficult to slide the carriage 24 over the the track 33.

FIG. 6 illustrates the action of the mounting where the arm 30b has encountered an obstacle on the mine floor. The upright tower remains directed at the mine roof and the bottom of the upright tower remains over the mine floor without intervening apparatus.

Having thus defined our invention in detail and with the particularity required by the Patent Laws, what is desired protected by Letters Patent is set forth in the following claims.

We claim:

1. An operator cab and drilling assembly for a roof drilling and bolting device including a mobile chassis comprising a cab having a front and a rear, said cab including a floor and a canopy spaced over the floor, said cab rear being arranged for fixing to said mobile chassis, a horizontal rail extending the entire length along the front edge of the floor of the cab and spaced therefrom, a swinging mount for said rail comprising two first arms extending forward from the cab, each journaled to opposite outer front edges of the floor, means journaled between the forward ends of the first arms, said journaled means comprising said rail as a portion thereof, a second arm pivotally mounted to said journaled means at one end and at the other end pivotally mounted to the cab such that lines through the pivot points of one of said first arms and the pivot points of said second arm define a parallelogram, a carriage slidably engaging the rail for transverse movement, an upright tower mounted to said carriage and spaced between the floor and rail, a drill pod slidably mounted on said upright tower for vertical movement, whereby the operator while under the canopy has easy access to the drill pod.

2. The cab and drilling assembly according to claim 1 in which the horizontal rail comprises a beam supporting an orbitig chain therein turning over sprockets journaled at each lateral end thereof, and the carriage being carried by said chain to move the carriage horizontally.

3. The cab according to claim 2 in which the upright tower mounted to the carriage comprises a hollow box-like structure having an extensible hydraulic means therein for raising and lowering the drill pod.

4. An apparatus according to claims 1 or 3 wherein a stabilizer for drill steel is mounted on the top of the upright tower for centering of said drill steel.

5. The cab according to claim 1 wherein the carriage is positioned between the rail and the front edge of the cab floor.

6. The cab according to claim 5 wherein a horizontal track extends along the front edge of the cab floor and the carriage rests on the track when the journaled is in its most downward position.

* * * * *

UNITED STATES PATENT AND TRADEMARK OFFICE

CERTIFICATE OF CORRECTION

PATENT NO. : 4,256,186
DATED : March 17, 1981
INVENTOR(S) : Henry P. Barthe et al.

It is certified that error appears in the above—identified patent and that said Letters Patent is hereby corrected as shown below:

Claim 6, column 4, line 66, after "journaled" insert -- means --.

Signed and Sealed this

*Second* Day of *June 1981*

[SEAL]

*Attest:*

RENE D. TEGTMEYER

*Attesting Officer*

*Acting Commissioner of Patents and Trademarks*